United States Patent [19]

Kriegesmann

[11] Patent Number: 4,558,836

[45] Date of Patent: Dec. 17, 1985

[54] SEMI-ACTIVE CONTROL SYSTEM FOR TRACKING AND ILLUMINATING A TARGET

[75] Inventor: Peter Kriegesmann, Ulm, Fed. Rep. of Germany

[73] Assignee: Licentia Patent-Verwaltungs-GmbH, Fed. Rep. of Germany

[21] Appl. No.: 522,664

[22] Filed: Aug. 12, 1983

[30] Foreign Application Priority Data

Aug. 14, 1982 [DE] Fed. Rep. of Germany ..... 3230267

[51] Int. Cl.[4] ..... F41G 7/30

[52] U.S. Cl. ..... 244/3.11

[58] Field of Search ..... 244/3.11

[56] References Cited

U.S. PATENT DOCUMENTS

| | | | |
|---|---|---|---|
| 3,001,186 | 9/1961 | Baltzer | 244/3.11 |
| 3,116,039 | 12/1963 | Goldberg | 244/3.11 |
| 3,300,777 | 1/1967 | Tarr | 343/6 |
| 3,371,887 | 3/1968 | Welti | 244/3.11 |
| 3,799,676 | 3/1974 | Chatterton | 356/152 |
| 3,974,383 | 8/1976 | Chapman | 244/3.11 |
| 4,143,835 | 3/1979 | Jennings, Jr. et al. | 244/3.11 |
| 4,406,429 | 9/1983 | Allen | 244/3.11 |

FOREIGN PATENT DOCUMENTS

| | | |
|---|---|---|
| 2162983 | 6/1973 | Fed. Rep. of Germany . |
| 2922592 | 11/1981 | Fed. Rep. of Germany . |
| 1454451 | 8/1966 | France . |
| 2470357 | 5/1981 | France . |
| 1064150 | 4/1967 | United Kingdom . |
| 1406707 | 9/1975 | United Kingdom . |

OTHER PUBLICATIONS

Stangl, A.; "Optische Folgeregelungen bei Lenkflugkörpern"; *Luftfahrttechnik. Raumfahrttechnik; 1969, pp. 208–210.*

*Primary Examiner*—Charles T. Jordan

*Attorney, Agent, or Firm*—McGlew and Tuttle

[57] ABSTRACT

In a semi-active system of missile guidance, simple illuminating devices, designated as transmitters only, are used for illuminating the target, instead of expensive target tracking devices. The illuminating devices are directed at the targets by the target locating equipment, within the periods of target information renewal. As compared to the target tracking systems, the half width of the directive diagrams of the illuminating device is definitely enlarged and so dimensioned that the illuminated solid angle encompasses the maneuvering space of the target within the period of information renewal.

12 Claims, 1 Drawing Figure

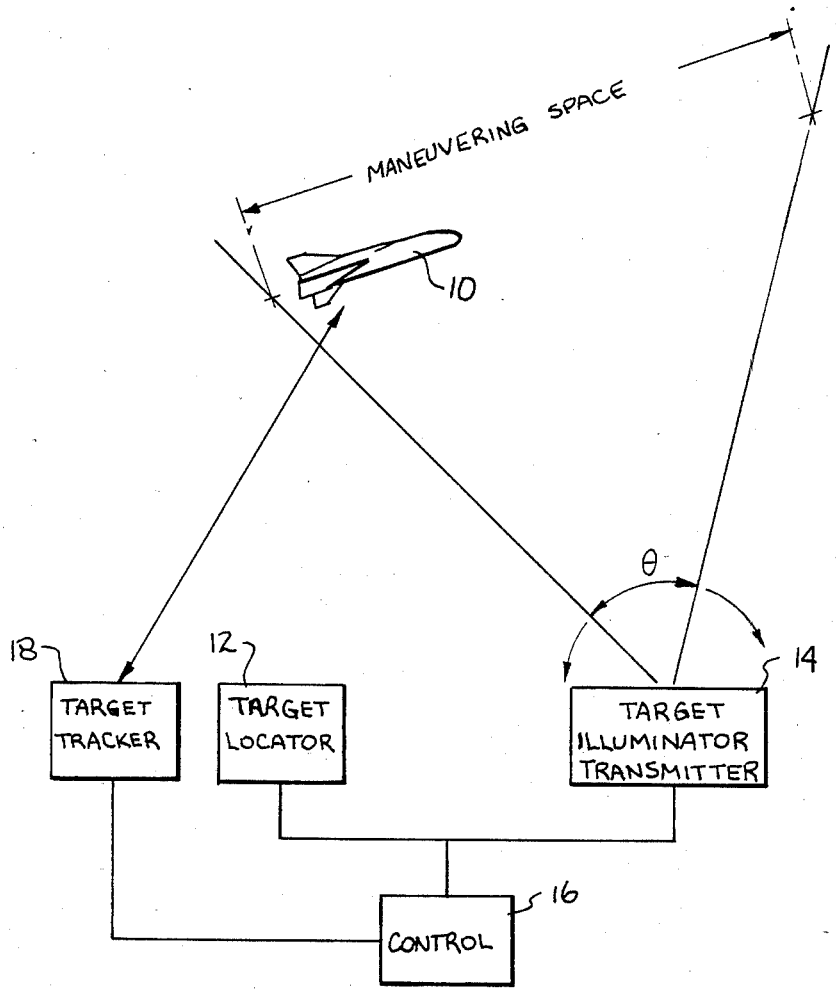
MANEUVERING SPACE
10
θ
18
12
14
TARGET TRACKER
TARGET LOCATOR
TARGET ILLUMINATOR TRANSMITTER
16
CONTROL

SEMI-ACTIVE CONTROL SYSTEM FOR TRACKING AND ILLUMINATING A TARGET

FIELD AND BACKGROUND OF THE INVENTION

The invention relates to missile guidance and in particular to a new and useful semi-active system of tracking for a target.

In a semi-active system of guidance, such as disclosed in German OS No. 21 62 983, for example, a target to be fought by the missile is irradiated with electromagnetic energy through an illuminator which is detached from the missile and, in general, is stationary. The radiation impinging on the target is reflected, especially also in the direction of the missile which thus passively receives information on the direction to be taken, from the relative direction of incidence of the respective portion of reflected radiation. Such a semi-active missile guidance may be effected during the entire flight or only during shorter intervals of the flight.

A basic requirement is to illuminate the target during such a semi-active phase of guidance continuously, maybe with the exception of very short interruptions.

For this purpose, systems are employed comprising on all-around search radar or a similar device for initially detecting a target. Since the antenna of a surveillance radar is directed at the target only for a short time and the radar signal is usually pulsatory, a surveillance radar is not a suitable device for illuminating the target. After all, a once detected target is illuminated by a target tracking radar having a very narrow pencil-beam directional pattern. From the echo portion reflected from a target to the target tracking radar, the instantaneous position of the target can be determined and this information can be used for pointing the narrow antenna lobe of the illuminator exactly at the target.

Since, as already mentioned, the target is to be illuminated during a semi-active phase continuously, only a single target can be illuminated in every instance by such a target tracking device. With a simultaneous lighting of a plurality of targets, i.e. a simultaneous guidance of several missiles, a plurality of target tracking devices of the same kind must be present. The multiplied costs connected thereto unfavorably affect the setting up of an effective system of guidance, since the complex, autonomous target tracking devices are very expensive.

SUMMARY OF THE INVENTION

The present invention is directed to a semi-active apparatus for tracking and illuminating a target, which can inexpensively be set up particularly also for a simultaneous guidance of a plurality of missiles.

In accordance with the invention there is provided a semi-active control system for a homing guided missile which comprises at least one target locating device and at least one target illuminating transmitter with a swingable directive pattern. The alignment of the directive pattern with the target being effected in accordance with the location of the target is determined by the target locating equipment. The control is connected to the target locating device and to the transmitter so as to adjust the alignment if necessary at every renewed information on the target location to establish a target directive pattern. The elevational azimuthal half widths of the directive pattern being at least such that the illuminated solid angle encompasses the maneouvering space of the target within the period of the information renewal of the target locating equipment.

In accordance with a method of controlling a homing guided missile using a target locating device and a target illuminating device, the illuminating transmitter is swung in the directive pattern of the target in accordance with the location of the target determined by the target locating equipment and the illumination is controlled as to alignment based on information of the target location from the target locator, the elevational and azimuthal half widths of the directive pattern is maintained so that the illuminated solid angle encompasses the maneouvering space of the target within the period of the information renewal of the target locating equipment.

What is substantial in the inventive system is that the illuminating device is designed only for transmitting signals, not for receiving the echoes, and therefore, it is not capable of independently tracking a target. Such an illuminating device without a receiving and evaluating capability of its own is much simpler in construction and therefore less expensive than an autonomous target tracking device. This is particularly advantageous if the system is to be extended to a plurality of illuminating devices. Since the illuminating device itself cannot locate the target, information on the target location necessary for orienting the directive pattern is taken from the target locating devices.

Accordingly, it is an object of the invention to provide an improved semi-active control system for a homing guided missile.

A further object of the invention is to provide a control system for a guided missile which is simple in design, rugged in construction and economical to manufacture.

A further object of the invention is to provide a method of controlling a homing guided missile using a target locating device and a target illuminating device wherein the information from the target locating device is used to establish an illumination which is at least such that the illuminated angle encompasses the maneouvering space of the target within the period of information renewal of the target locating equipment.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

BRIEF DESCRIPTION OF THE DRAWINGS

In the drawings:

The only FIGURE of the drawing is a schematic representation of an apparatus for tracking and illuminating a target and constructed in accordance with the invention.

DESCRIPTION OF THE PREFERRED EMBODIMENTS

Referring to the drawing in particular the invention embodied therein comprises a method and apparatus for controlling a homing guided missile.

Upon detecting a missile or a target 10 and determining its location by a target locating device 12, values for setting an illuminating device 14 are derived from the information on the target, and transmitted thereto through a control 16. The semi-active guidance by illumination of a missile to the detected target 10 is effected by the illuminating device 14. The target locating devices 12 are thus free to continue their watch of the entire space for further targets. In accordance with the data of the detected target, or those transmitted for setting, the directive diagram is then aligned by means of usual setting means.

The entire space to be watched is normally periodically scanned by the target locating devices 12 particularly an all-around search radar. Therefore, after a certain period of information renewal, the target 10 illuminated by the illuminating device is again picked up by the target locating devices. Thereby, a new location of the target, which continues to move in the meantime, is detected and the directional pattern of the illuminating device is readjusted in accordance with the new location of the target.

To avoid an escape of the target from the range of the directive pattern of the illuminating device during the period of information renewal, so that the missile would no longer "see" the target, the provided solid angle $\theta$ illuminated by the directive diagram, i.e. the azimuthal and elevational widths of the directional lobe, is such that it exceeds or at least equals the maneouvering space of the target within the period of information renewal. The limits of this maneouvering space depend on the extent of the period for information renewal, the actual data of the target, and the presumptive maneouvering capability of the target. The technique of working within a maneouvering space of the target is known from track forming radar systems.

Since the maneouvering space also depends on the target space which, as a rule, varies constantly, an advantageous development of the invention provides to make the shape, thus the width in elevation and azimuth, of the directional pattern of the illuminating device variable, so as to be able to adjust the solid angle illuminated through the directional pattern to the actual data of the target.

Even a plurality of illuminating devices with complementary illumination spaces may be provided for illuminating an angle space, then, if a target passes from one angle space portion to the other, the new illuminating device assumes the function of the preceeding one.

The invention is particularly suitable for supplementing or extending prior art systems comprising an all-around search radar for monitoring the space, and one or more target tracking devices having narrow, approximately pencil-beam directive diagrams. In accordance with the invention, in such instances, the all-around search radar and the target tracking devices substantially assume the function of the target tracking devices.

In an advantageous design, it is provided that after the target has been detected by the all-around search radar 12, a target tracking device 18 is pointed at the target to determine the exact position thereof. With a target tracking device, also the elevation of the target can be determined, while an all-around search radar frequently allows only the determination of the azimuth. At the same time, advantageously, the target tracking device may effect the initial illumination of the target.

In another advantageous embodiment, after exactly determining the location of the target and deriving therefrom the respective values for setting, the illuminating device takes over the illumination of the target. Thereby (after the frequency change), the target tracking device becomes free for a new target.

Still another advantageous embodiment provides that the target tracking device effects the illumination of the target until the target has approached the illuminating device to a distance which, for illustration, might be called range of the illuminating device. With equal transmission powers, if a target tracking device is used for the illumination, the energy incident on the target and thus the intensity of the signals reflected toward the missile is higher, since the directional beam is substantially more focused.

Another advantageous embodiment of the invention develops the idea that if a single target is present, it is advantageous to illuminate the target during the entire flight period (or the semi-active phase) of the missile through the target tracking device, and only if another target appears, to transmit the illuminating function to the illuminating device and use the target tracking device for locating and maybe illuminating the new target.

Still another advantageous embodiment provides that if a plurality of targets is present, each target is illuminated through one illuminating device 14, and the target tracking device 18 is used for determining in cyclical sequence the location of the illuminated targets, independently of other target locating devices 12. The period for information renewal may thus be considerably reduced.

The individual operating modes and the cooperation of the various components of the system are advantageously controlled through a central computer or control 16. In a manner known per se, the computer 16 delivers the specific setting quantities for operating the missile, such as the frequency, instant of transmission, and modulation of illuminating signal.

During intermissions in which they are not needed for guiding the missile, the illuminating devices may perform a decoy job under the central control.

While specific embodiments of the invention have been shown and described in detail to illustrate the application of the principles of the invention, it will be understood that the invention may be embodied otherwise without departing from such principles.

I claim:

1. A semi-active control apparatus for tracking and illuminating a target which is maneuverable within a maneuvering space comprising at least one target-locating device for periodically renewing information on target location, at least one target illuminating transmitter for only radiating electromagnetic waves in a swingable directive pattern for illuminating a solid angle and being limited by an elevational and azimuthal half width of the electromagnetic waves, the alignment of the directive pattern with the target being effective in accordance with the location of the target determined by said target-locating device, a control connected to said target-locating device and said transmitter for adjusting, if necessary, after every renewed information on the target-location to establish a target directive pattern, the elevational and azimuthal half widths of said directive pattern being at least such that the illuminated solid angle encompasses the maneuvering space of the target within the period of the information renewal of the target locating device.

2. A semi-active control apparatus according to claim 1, wherein said target locating device comprises an all-around search radar.

3. A semi-active control apparatus according to claim 1, wherein said target locating device comprises a target tracking device having approximately a pencil beam pattern.

4. A semi-active control apparatus according to claim 3, wherein an initial illumination of the target is effected by said target tracking device.

5. A semi-active control apparatus according to claim 4, wherein upon determining the target location, the illumination of the target is taken over by the target illuminating transmitter.

6. A semi-active apparatus according to claim 4, wherein the target illuminating transmitter takes over the illumination as soon as a distance to the target falls below a maximum value.

7. A semi-active control apparatus according to claim 5, wherein the illumination of the target is taken over by the illuminating transmitter only if another target is present.

8. A semi-active control apparatus according to claim 1, including a plurality of illuminating transmitters which are operable independently of each other and which each illuminate a solid angle.

9. A semi-active control apparatus according to claim 1, wherein solid angles of the plurality of illuminating transmitters complement and partly overlap each other.

10. A semi-active control apparatus according to claim 1, wherein said control is a control computer for deriving from the target information of the target locating device a setting for the illuminating transmitter.

11. A semi-active control apparatus according to claim 1, wherein the shape of the directive pattern is variable.

12. A method of semi-actively tracking and illuminating a target which is maneuverable within a maneuvering space and utilizing a target locating device and a target illuminating transmitter, comprising periodically renewing information from the target-locating device on target location, illuminating the target using electromagnetic waves transmitted from the target illuminating transmitter in a direction pattern having a solid angle as being limited by an elevational and azimuthal half width of the electromagnetic waves, swinging the directive pattern according to the location of the target determined by the target locating device, and maintaining the elevational and azimuthal half widths of the solid angle of the directive pattern to encompass the maneuvering space of the target within each period of renewed information from the target locating device.

* * * * *